US006973889B2

(12) United States Patent
Ochi et al.

(10) Patent No.: US 6,973,889 B2
(45) Date of Patent: Dec. 13, 2005

(54) OVERLOCK SEWING MACHINE

(75) Inventors: Moriya Ochi, Toyota (JP); Kazuhiro Murase, Anjo (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 8 days.

(21) Appl. No.: 10/776,251

(22) Filed: Feb. 12, 2004

(65) Prior Publication Data

US 2004/0206284 A1 Oct. 21, 2004

(30) Foreign Application Priority Data

Feb. 12, 2003 (JP) ..... 2003-034434

(51) Int. Cl.[7] ..... D05B 19/00
(52) U.S. Cl. ..... 112/470.01; 112/162
(58) Field of Search ..... 112/470.01, 163, 112/165, 166, 172

(56) References Cited

U.S. PATENT DOCUMENTS 4,422,394 A * 12/1983 Bergvall ..... 112/445
4,873,931 A * 10/1989 Takagi et al. ..... 112/470.01
5,333,560 A * 8/1994 Yoshida ..... 112/470.04
6,467,418 B1 * 10/2002 Reina et al. ..... 112/167

FOREIGN PATENT DOCUMENTS

JP 56-163689 12/1981
JP 61-92693 5/1986

* cited by examiner

*Primary Examiner*—John J. Calvert
*Assistant Examiner*—Brian Kauffman
(74) *Attorney, Agent, or Firm*—Oblon, Spivak, McClelland, Maier & Neustadt, P.C.

(57) ABSTRACT

An overlock sewing machine includes: a main body; a needle bar mounted to reciprocate in an axial direction; plural needles positioned at the needle bar; a main feeding mechanism adjusted to control a cloth feeding amount of a main feed dog; a differential feeding mechanism adjusted to control a cloth feeding amount of a differential feed dog; a memorizing device configured to memorize at least one sewing pattern, the memorizing device being provided at the main body; a pattern selecting device provided at the main body and configured to select the at least one sewing pattern memorized in the memorizing device; and a control device provided at the main body and configured to control the selected at least one sewing pattern.

28 Claims, 12 Drawing Sheets

Conventional Work

OVERLOCK SEWING MACHINE

CROSS REFERENCE TO RELATED APPLICATIONS

This application is based on and claims priority under 35 U.S.C. § 119 to Japanese Patent Application 2003-034434, filed on Feb. 12, 2003, the entire content of which is incorporated herein by reference.

FIELD OF THE INVENTION,

This invention generally relates to an overlock sewing machine for use in a home.

BACKGROUND

A conventional sewing machine or overlock sewing machine (hereafter "sewing machine") that can form intermittently gathered seams during a sewing process has been widely known. According to this type of sewing machine, the intermittently gathered seams can be formed by temporally differentiating a cloth feeding amount of a main feed dog from a cloth feeding amount of a differential feed dog during the sewing process.

In more detail, the sewing machine is provided with a needle bar that reciprocates in an up and down direction towards a work cloth plate. A needle firmly supported by a tip end of the needle bar is adapted to go through a center hole of a throat plate. The main feed dog and the differential feed dog are arranged at a far side of the center hole and at a near side thereof. Each amount of movement of the main feed dog and the differential feed dog can be adjusted and controlled by use of an electric driving power source such as a pulse motor. Therefore, the cloth feeding amount of the main feed dog and the differential feed dog can be controlled in response to the activation of the pulse motor.

Still, another conventional sewing machine has been manufactured, which can finish seams by minimizing a moving amount of a feed main dog during a sewing process or after stopping the operation of the sewing machine. In this case, the moving amount of the main feed dog is minimized while maintaining a relative ratio between a cloth feeding amount of the main feed dog and a cloth feeding amount of a differential feed dog.

Japanese Laid-Open Patent Publication No. 1986-92693 (pp.2–13, FIG. 3) describes a method of forming intermittently gathered seams on a work cloth and an apparatus for forming the same. Further, Japanese Laid-Open Patent Publication No. 1981-163689 (pp. 2–4, FIG. 2) describes a sewing machine capable of adjusting a feeding amount of a feed dog. The sewing machine with a feed regulating function can change seams by differentiating a cloth feeding amount of a main feed dog from a cloth feeding amount of a differential feed dog at an intended timing during a sewing process.

According to JP 1986-92693, as illustrated in FIG. 13 of the present specification, a sewing machine main body M houses a regulating mechanism including the main feed dog, the differential feed dog, and a pulse motor. A control box C is provided separately from the sewing machine main body M and houses a control circuit, an operating portion and a display portion together. The control circuit memorizes and calls several types of control patterns for controlling or changing the feeding amount of the differential feed dog in response to the predetermined number of stitches. The operating portion selects, modifies, and sets any one of the memorized control patterns. The display portion displays information on the selected control pattern.

As illustrated in FIG. 13, the sewing machine main body M and the control box C are assembled with a distance therebetween. Therefore, the entire sewing system is very large and would not be appropriate for use at home. Further, the sewing machine main body M that actually forms stitches is positioned at a distance from the operating portion. Therefore, there are still issues for both operating performance and safety while operating the operating portion.

According to the sewing machine with the feed adjusting function, the moving amount of the differential feed dog is controlled in response to a command generated by depressing a foot pedal. However, a home sewing machine is generally operated by use of a foot pedal or a speed controller. Therefore, it may be difficult to operate plural foot pedals, and each foot pedal may be operated unnecessarily by mistake. This may badly influence accessibility of the operating members.

A need thus exists for providing an improved home sewing machine capable of changing a first sewing pattern to another sewing pattern while performing the first sewing pattern. The present invention also enables the home sewing machine to be more compact and to be operated with improved accessibility to an operating member while achieving improved safety.

SUMMARY OF THE INVENTION

In light of the above-described difficulties, the Applicants developed the present invention. To this end, one aspect of the invention provides an overlock sewing machine including: a main body; a needle bar mounted to reciprocate in an axial direction; plural needles positioned at the needle bar; a main feeding mechanism adjusted to control a cloth feeding amount of a main feed dog; a differential feeding mechanism adjusted to control a cloth feeding amount of a differential feed dog; a memorizing device configured to memorize at least one sewing pattern, the memorizing device being provided at the main body; a pattern selecting device provided at the main body and configured to select the at least one sewing pattern memorized in the memorizing device; and a control device provided at the main body and configured to control the selected at least one sewing pattern.

Another aspect of the invention provides an overlock sewing machine including: a main body; a needle bar mounted to reciprocate in an axial direction; plural needles positioned at the needle bar; a main feeding mechanism adjusted to control a cloth feeding amount of a main feed dog; a differential feeding mechanism adjusted to control a cloth feeding amount of a differential feed dog; a memorizing device configured to memorize at least one sewing pattern, the memorizing device being provided at the main body; a pattern selecting device provided at the main body and configured to select the at least one sewing pattern memorized in the memorizing device or to select a manual operation; and a control device provided at the main body and configured to control the selected at least one sewing pattern, the at least one sewing pattern including an intermittent gathering pattern and a finishing pattern, the intermittent gathering pattern being performed by repeatedly changing a feeding amount of the differential feed dog relative to a feeding amount of the main feed dog based on an interval of an intended number of stitches, and the finishing pattern being performed by substantially simultaneously minimizing feeding amounts of the main feed dog and the differential feed dog based on an intended number of stitches.

The present invention also provides a method of changing a first sewing pattern to a second sewing pattern when the first sewing pattern is in use, the method including: presenting at least one sewing pattern to a user; recognizing selection of a first sewing pattern; acknowledging the selection of the first sewing pattern to the user; driving a motor for the sewing machine when operation of the sewing machine is required; detecting selection of a second sewing pattern; and transitioning to the second sewing pattern while the first sewing pattern is in use.

Another aspect of the invention includes an overlock sewing machine, including: a main body; a needle bar mounted to reciprocate in an axial direction; plural needles positioned at the needle bar; first means for controlling a cloth feeding amount of a main feed dog; second means for controlling a cloth feeding amount of a differential feed dog; means for memorizing at least one sewing pattern; means for selecting the at least one sewing pattern or for selecting a manual operation; means for displaying the selected at least one sewing pattern; and means for controlling the selected at least one sewing pattern, wherein the selected at least one sewing pattern is changed to a second sewing pattern during when the selected at least one program is in use.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
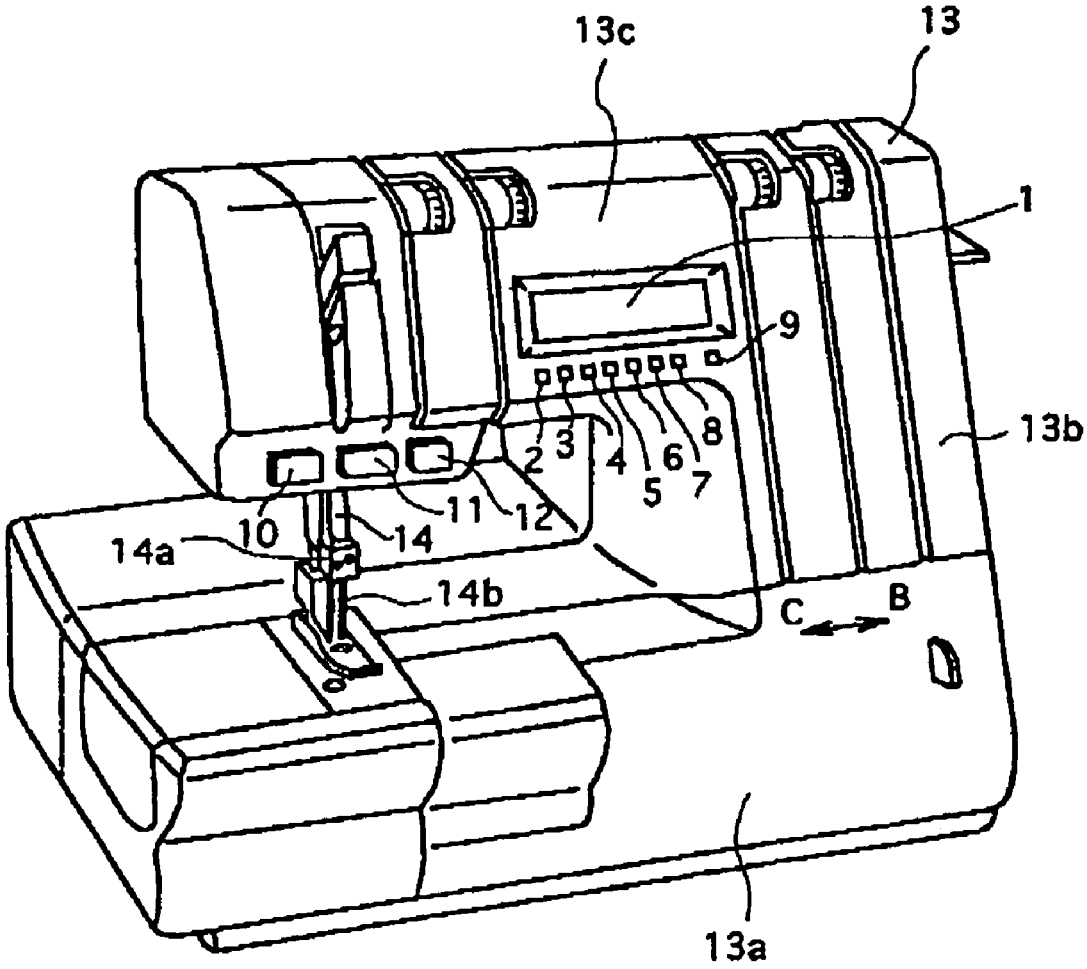
FIG. 1 is a perspective view illustrating an entire exterior view of an overlock sewing machine according to a non-limiting embodiment of the present invention.

As illustrated in FIGS. 1 through 4, an overlock sewing machine is provided with a needle bar 14 holding plural needles and adjusted to reciprocate in a vertical direction, and plural looper mechanisms. This overlock sewing machine can form over-edge seams and double chain-stitch seams.

The overlock sewing machine is further provided with a main feeding mechanism having a main feed dog 27, a differential feeding mechanism having a differential feed dog 34, a memorizing device, operating portions 2 through 12, a display device 1, a feed adjuster 17, and a differential feed bar drive arm 36. Both the main feed dog 27 and the differential feed dog 34 are adjusted to control a cloth feeding amount by an actuator, such as a pulse motor for non-limiting example.

Figure 9:
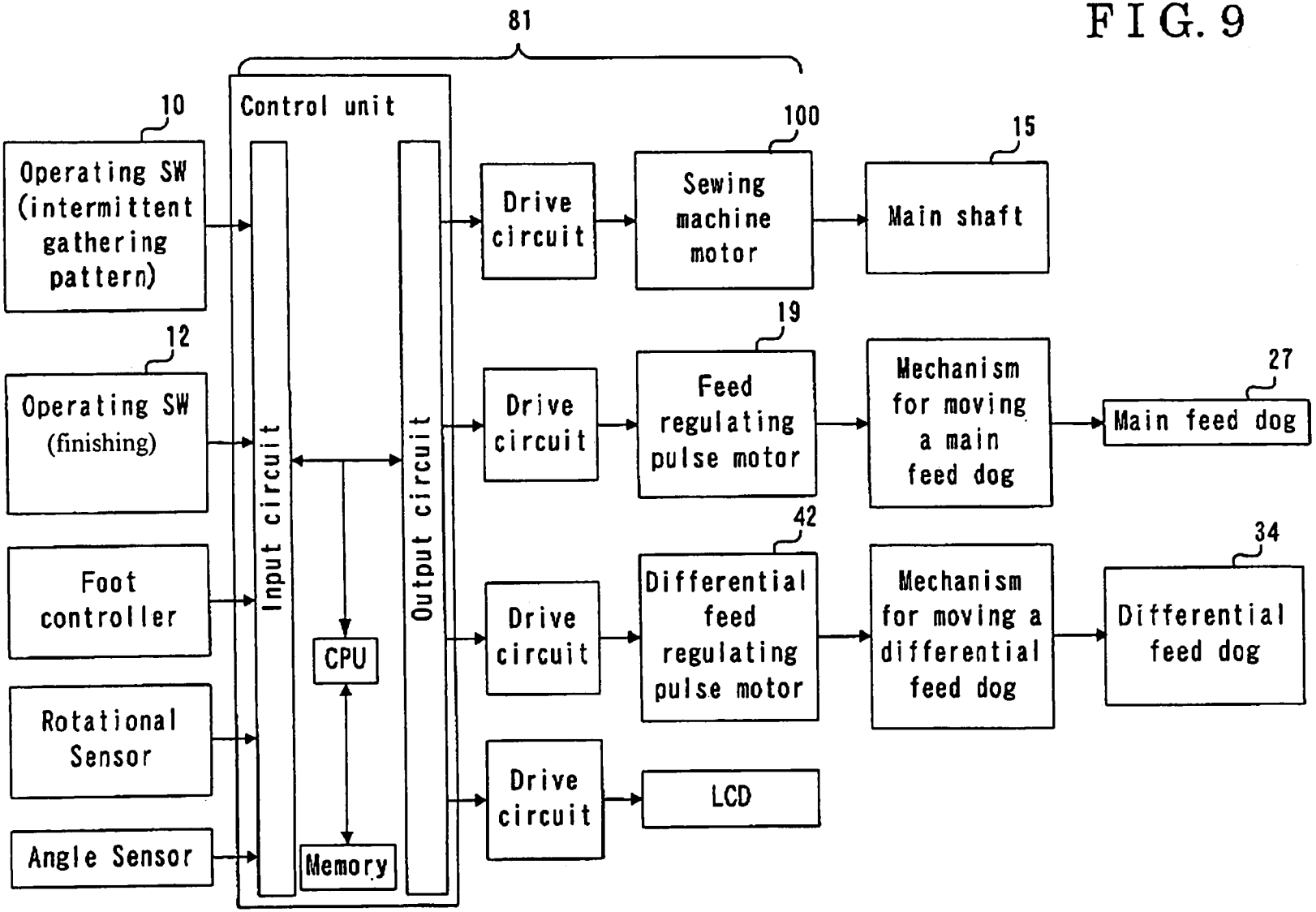
FIG. 9 is a block view for explaining a function of the overlock sewing machine.

The overlock sewing machine according to the non-limiting embodiment of the present invention is also illustrated in FIG. 9.

The memorizing device is configured to memorize various types of sewing patterns. The operating portions 2 through 12 (the pattern selecting device) are operated to select the respective types of sewing patterns memorized in the memorizing device or to select a manual operation. The display device 1 displays the respective types of sewing patterns. The feeding adjuster 17 is configured to control a moving amount of the main feed dog 27 based upon the selected sewing pattern. The differential feed bar drive arm 36 is adjusted to control a moving amount of the differential feed dog 3 based upon the selected sewing pattern.

A sewing pattern for finishing and an intermittent differential feed sewing pattern, i.e., an intermittent gathering pattern, are non-limiting examples of the various sewing patterns of this overlock sewing machine. In the sewing pattern for finishing, the feeding amounts of the main feed dog 27 and the differential feed dog 34 are approximately simultaneously minimized after forming the intended number of stitches. In the intermittent gathering pattern, the feeding amount of the differential feed dog 34 relative to the feeding amount of the main feed dog 27 is repeatedly changed with respect to an intended number of stitches between a gathering portion and a non-gathering portion.

As illustrated in FIG. 1, the display 1 is mounted at a front outer portion of the overlock sewing machine and can display various types of information. The display 1 may include, for example, a liquid crystal display panel. The display device 1 can display a wide variety of information for each sewing pattern. For example, the display device 1 displays a set-up-condition of the overlock sewing machine. The display device 1 further displays several conditions applied for the selected sewing pattern, a warning signal or note for warning a user that the overlock sewing machine is going to be operated under an inappropriate condition for the selected sewing pattern, and a navigation guide for recovering the overlock sewing machine from an inappropriate set-up condition to an appropriate set-up condition. The display device 1 still further displays a set value of a feature to be changed upon changing or controlling predetermined sewing conditions for each pattern. Therefore, the overlock sewing machine according to the non-limiting embodiment of the present invention may enable improved operating performance of the sewing machine.

The operating portions 2 through 12 are arranged near the display portion 1 and are operated to select one of the various types of sewing patterns, (e.g., to change or newly set the set value and so on). The operating portion 9 is operated to select the maximum sewing speed in phase and to restrain the maximum sewing speed. The operating portion 10 is operated to initiate an intermittent gathering at a desired sewing position. The operating portion 11 is operated to control a movement of the differential feed dog 34. The operating portion 12 is operated to control feeding of cloth appropriate for finishing. The operating portions 9, 10, 11, and 12 are positioned to be differentiated from the operating portions 2 through 8.

The following description will describe in more detail the structure and function of these operating portions 2 through 12. The operating portion 2 is operated to sequentially select and display respective types of the sewing patterns performed by the overlock sewing machine according to the non-limiting embodiment of the present invention. The operating portion 3 is operated to select a machine condition that the user intends to change. The operating portions 4 and 5 are operated to change (e.g., increase and decrease) the condition selected by the operating portion 3. The operating portion 6 is operated to set the sewing pattern selected by the operating portion 2 and to set the condition changed by the operating portion 4 or 5. The operating portion 7 is operated to memorize and call the condition set by the user. The operating portion 8 is operated to select an outline of a cloth type suitable for the sewing pattern selected by the operating portion 2, thereby displaying a recommended condition for each work cloth in the display device 1. These operating portions 2 through 8 are not usually operated during the sewing process.

The operating portion 9 is operated to select the maximum sewing speed in phase and to restrain the maximum sewing speed. The operating portion 10 is operated to initiate a program for forming intermittent gathering seams at an intended position of the work cloth. This program for forming the intermittent gathering seams is performed by repeatedly controlling the change and return of a ratio of a cloth feeding amount of the differential feed dog 34 relative to a cloth feeding amount of the main feed dog 27 (hereinafter, referred to a cloth feeding amount ratio of the differential feed dog 34 relative to the main feed dog 27). Further, this program for forming the intermittently gathered seams is performed based upon a predetermined control pattern. The operating portion 11 is operated to form gathered seams at a user's intended position and with an intended sewing length. The gathered seams are formed by controlling or changing the cloth feeding amount ratio of the differential feed dog 34 relative to the main feed dog 27 to a predetermined amount.

The operating portion 12 is operated for finishing (e.g. when the sewing machine needs to be rethreaded). The finishing can be performed by minimizing a moving amount of the main feed dog 27 while maintaining the cloth feeding amount ratio of the differential feed dog 34 relative to the main feed dog 27. The operating portions 9, 10, 11, and 12 may be operated before, during, and after the sewing process. As seen in FIG. 1, the operating portions 9, 10, 11 and 12 are differentiated from the operating portions 2 through 8 in regard to the respective structures and mounted positions. This prevents operational mistakes by the user. Further, this can lead to enhancement of operability and usefulness to operate each operating portion and further lead to enhancement of safety when using the sewing machine.

Figure 2:
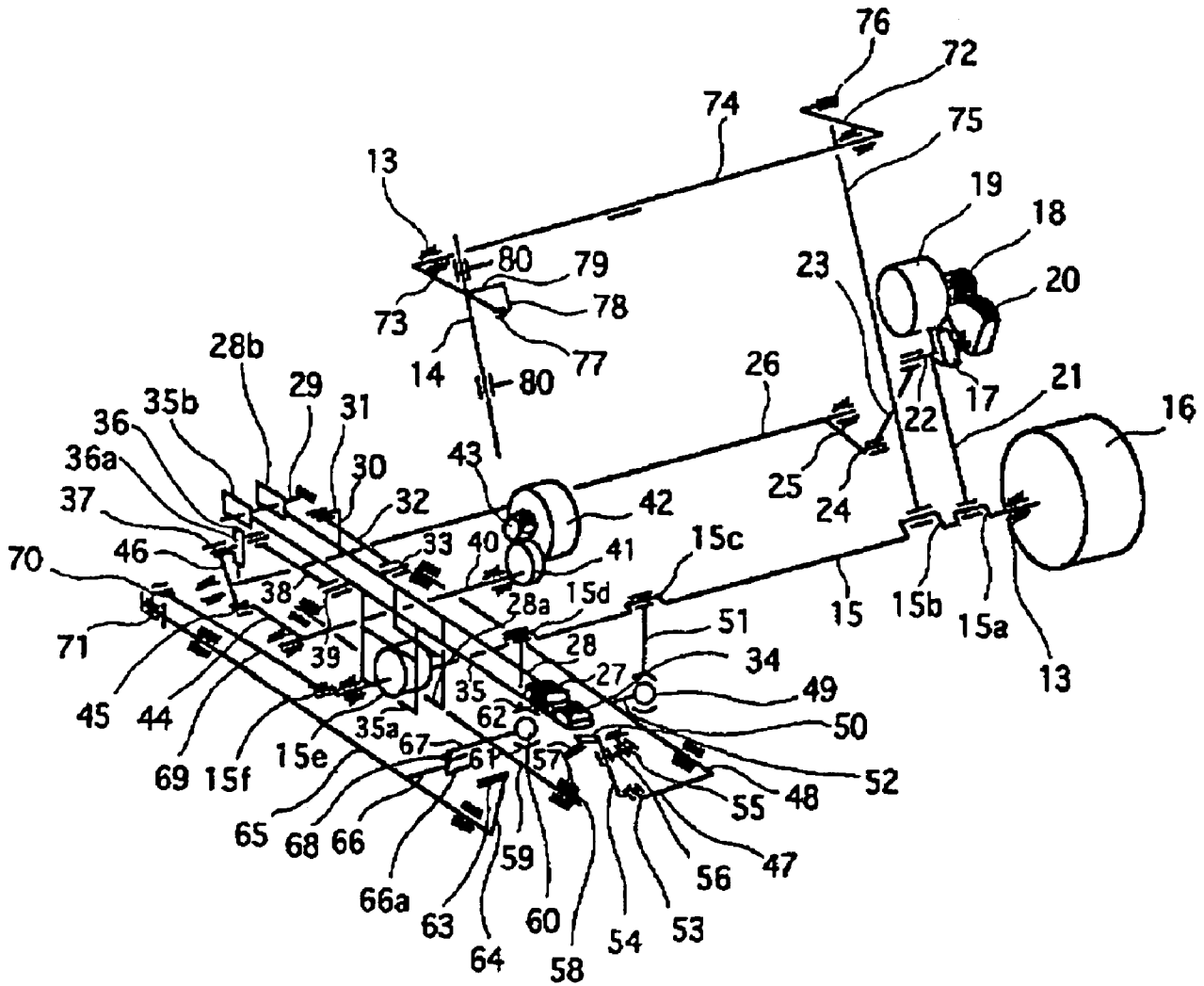
FIG. 2 is a schematic view illustrating an entire mechanism of the overlock sewing machine according to the embodiment of the present invention.
Figure 3:
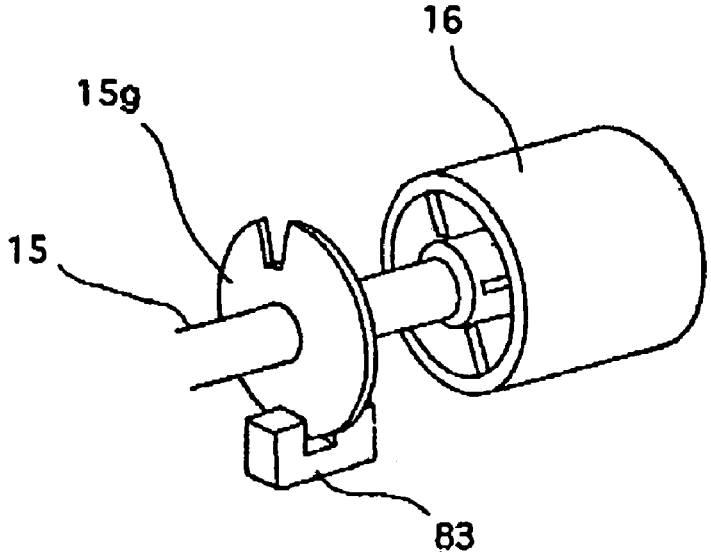
FIG. 3 is a partial perspective view for explaining a needle position detecting device according to the embodiment of the present invention.
Figure 4:
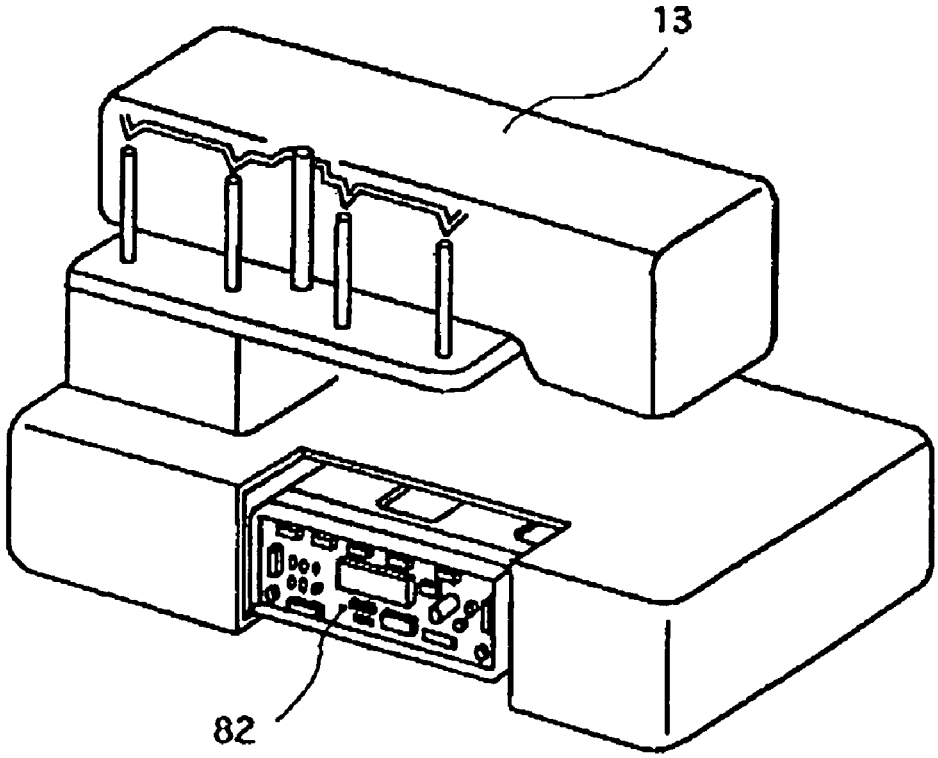
FIG. 4 is a partial cross sectional view illustrating a back side of the overlock sewing machine according to the embodiment of the present invention.

As illustrated in FIG. 2, an overlock sewing machine frame 13 includes a bed portion 13*a*, an leg portion 13*b* integrally provided at a right side of the bed portion 13*a* in FIG. 1, and an arm portion 13*c* horizontally extending from the opening end of the leg portion 13*b* at an upper side of the bed portion 13*a*. The needle bar 14 holding a needle 14*a* is provided on the lower end portion of the arm portion 13*c*. The needle bar 14 reciprocates up and down to form stitches on the work cloth.

In FIG. 1, when an operator (not shown) is in front of the overlock sewing machine, a work cloth is fed from the near side to the far side. An orthogonal direction to the cloth feeding direction and the vertical reciprocating direction of the needle bar 14 is a right-left direction (B–C direction) in FIG. 1. Hereafter, the direction and the physical relationship are expressed such as the right-left direction, the vertical direction, and the near side as viewed in FIG. 1.

As illustrated in FIG. 2, a main shaft 15 is arranged with drive cams 15*a*, 15*b*, 15*c*, 15*d*, 15*e*, and 15*f* (described later) at random positions. The main shaft 15 is rotatably supported by the sewing machine frame 13 around both ends thereof. A balance wheel 16 is provided on a right end portion of the main shaft 15. The feed adjuster 17 is also rotatably supported by the sewing machine frame 13. A gradient angle of the feed adjuster 17 can be altered via a feed regulating worm wheel 20 by a feed regulating pulse motor 19 having a feed regulating worm 18. In response to the change of the gradient angle of the feed adjuster 17, the feed adjuster 17 can adjust a rotational movement of the horizontal feed drive cam 15*a* and shift the adjusted rotational movement to a reciprocating rotational movement of a feed shaft 26. That is, the rotational movement of the horizontal feed drive cam 15*a* can be transmitted to the feed shaft 26 via a feed drive rod 21, a feed drive rod pin 22, a feed connecting rod 23, a feed drive arm pin 24, and a feed drive arm 25. The feed shaft 26 can be rotated within a predetermined rotational angle.

The main feed dog 27 is positioned on the near side end of a main feed bar 28. The main feed dog 27 defines horizontal guiding grooves 28*a* and 28*b*. The horizontal guiding groove 28*a* is engaged with the feed lifting drive cam 15*e* to assist the main feed dog 28 to reciprocate back and forth. The horizontal guiding groove 28*b* is engaged with a feed bar supporting shaft 29 to assist the main feed dog 28 to reciprocate back and forth. The feed bar supporting shaft 29 is horizontally arranged and is fixed to the sewing machine frame 13. A main feed bar drive arm 30 is firmly arranged at the feed shaft 26. The main feed bar drive arm 30 urges a main feed bar pin 33 fixed to the main feed bar 28 to reciprocate back and forth via a main feed bar drive arm pin 31 and a main feed bar drive rod 32. Therefore, the main feed dog 27 can be moved elliptically by the cooperation of the main feed bar drive arm 30 and the feed lifting drive cam 15*e*.

The differential feed dog 34 is positioned on the near side end of a differential feed bar 35. The differential feed dog 34 defines horizontal guiding grooves 35*a* and 335*b*. The horizontal guiding groove 35*a* is engaged with the feed lifting drive cam 15*e* to assist the differential feed dog 34 to reciprocate back and forth. The horizontal guiding groove 28*b* is also engaged with the feed bar supporting shaft 29 to assist the differential feed dog 34 to reciprocate back and forth.

A differential feed bar drive arm 36 is firmly arranged on the feed shaft 26. The differential feed bar drive arm 36 includes a guiding groove 36*a* extending in a radial direction. The differential feed bar drive arm 36 assists a differential feed bar pin 39 fixed to the differential feed bar 35 to reciprocate back and forth. In more detail, the differential feed bar drive arm 36 assists the differential feed bar pin 39 via a differential feed bar drive arm pin 37 and a differential feed bar drive rod 38. Therefore, the differential feed dog 34 can be moved elliptically through the cooperation of the differential feed bar drive arm 36 and the feed lifting drive cam 15*e*.

A differential feed regulating shaft 40 is rotatably supported by the sewing machine frame 13. A differential feed regulating worm wheel 41 is fixed at one end of the differential feed regulating shaft 40. The differential feed regulating worm wheel 41 is engaged with a worm 43 integrally fixed at a differential feed regulating pulse motor 42 arranged at the sewing machine frame 13 such that rotation of the differential feed regulating worm wheel 41 can be adjusted. A differential feed regulating arm 44 is fixed to the other end of the differential feed regulating shaft 40. The differential feed regulating arm 44 regulates movement or oscillation of the differential feed bar drive arm pin 37 (the movement or oscillation is along the guiding groove 36*a* of the differential feed bar drive arm 36) via a differential feed regulating arm pin 45 and a differential feed regulating link 46, thereby adjusting the reciprocating amount of the differential feed bar 35 back and forth.

An upper looper drive shaft 48 is rotatably supported by the sewing machine frame 13 at both ends. An upper looper arm 47 is fixed at the near side end of the upper looper drive shaft 48. The upper looper drive shaft 48 is further provided with an upper looper drive arm 50 having a first end extending near an intermediate portion of the upper looper drive shaft 48. A ball portion 49 is defined at the other end of the upper looper drive arm 50. A rotation of the upper looper drive cam 15*c* is converted and a reciprocating rotation is transmitted to the upper looper drive shaft 15*c*. An upper looper bar 54 is fixed with an upper looper 52 at an upper end portion thereof. In the meantime, a lower end portion of the upper looper bar 54 is fixed to an upper looper arm pin 53 fixed to an opening end of the upper looper arm 47. Therefore, the upper looper bar 54 is rotatably supported by the upper looper arm pin 53. An upper looper oscillating link pin 55 is supported by the sewing machine frame 13 at a far end thereof. The upper looper bar 54 is engaged with an upper looper oscillating link 56 (supported with a rotational center of the upper looper oscillating link pin 55). Therefore, approximately circular movement can be generated around an end portion of the upper looper 52.

A lower looper drive shaft 59 is rotatably supported by the sewing machine frame 13 at both ends thereof. A lower looper arm 58 having a lower looper 57 is fixed to the near side end portion of the lower looper drive shaft 59. A lower looper drive arm 61 extends from a central portion of the lower looper drive shaft 59 or around. A ball portion 60 is defined at an opening end of the lower looper drive arm 61. A rotation of the lower looper drive cam 15*d* is converted and a reciprocating rotation is transmitted to the lower looper drive cam 15*d*.

An annular looper drive shaft 65 is rotatably supported by the sewing machine frame 13 at both ends thereof. An annular looper arm 64 is fixed to the near side end of the annular looper drive shaft 65. The annular looper arm 64 is provided with an annular looper 63 at an opening end portion thereof. An annular looper driven arm 66 extends from a central portion of the annular looper drive shaft 65 or around. A forked guiding portion 66*a* is defined at an opening end of the annular looper driven arm 66. An annular looper drive arm 67 extending from the lower looper drive shaft 59 is fixed with an annular looper drive arm pin 68 at an opening end thereof. The annular looper drive arm pin 68 is engaged with the forked guiding portion 66*a*. Therefore, a reciprocating rotation can be generated in the annular looper drive shaft 65.

An annular looper connecting arm 71 is connected to a rear end portion of the annular looper drive shaft 65. The annular looper connecting arm 71 is allowed to rotate. Rotation of the annular looper drive cam 15*f* can be transmitted to the annular looper drive shaft 65 via an annular looper drive rod 69, an annular looper connecting arm pin 70, and the annular looper connecting arm 71. The annular looper drive shaft 65 can be then moved in an axial direction. Therefore, a circular movement in the right-left direction and an elliptical movement can be generated to a tip end of the annular looper 63.

A needle bar drive shaft 74 is fixed with a first needle bar drive arm 72 and a second needle bar drive arm 73 at both ends thereof and is rotatably supported by the sewing machine frame 13. The rotation of the needle bar drive cam 15*b* can be transmitted to the needle bar drive shaft 74 via a needle bar drive rod 75 and a needle bar drive pin 76. Therefore, a reciprocating rotation can be generated in the needle bar drive shaft 74.

A needle bar drive link 78 is rotatably linked to the second needle bar arm 73 via a needle bar drive link pin 77. A needle bar joint coupling 79 is fixed to the needle bar 14 and supported by the needle bar 78. The reciprocating rotation of the needle bar drive shaft 74 can be operatively transmitted to the needle bar 14 by the needle bar drive link 78 and the needle bar through a joint coupling 79. A plurality of needle bar holders 80 are arranged in an approximately vertical direction and are fixed to the sewing machine frame 13.

According to one embodiment of the present invention, there is a pair of needle bar holders 80 fixed to the sewing machine frame 13. The needle bar holders 80 restrain a moving angle of the needle bar 14 and hold the needle bar 14 for slidable movement. Therefore, the reciprocating rotation of the second needle bar drive arm 73 can be converted to a reciprocating movement in a vertical direction. A needle 14*b* is fixed to a lower tip end of the needle bar 14 by a needle holder 14*a*.

The following description explains a process for finishing and intermittently gathered seams by the overlock sewing machine according to the non-limiting embodiment of the present invention.

Figure 10:
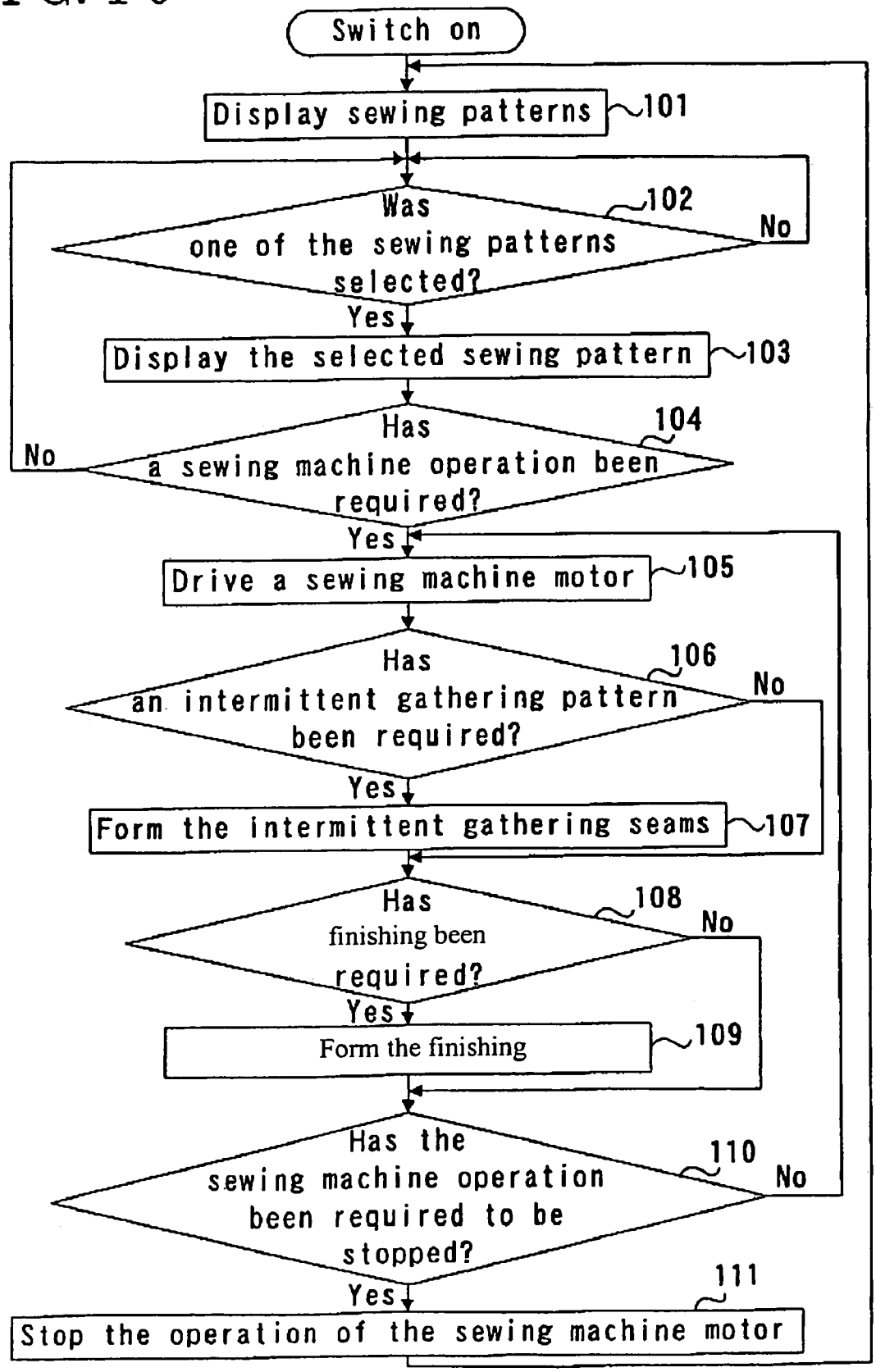
FIG. 10 is a flowchart for explaining a control process for finishing and the intermittent gathering pattern according to the embodiment of the present invention.

As illustrated in FIG. 10, a sewing program is initiated upon turning on a power source. At step 101, the respective sewing patterns to be performed are sequentially displayed by operating the operating portion 2. At step 102, the CPU judges whether one of the sewing patterns has been selected (the selection is performed by operating the operating portion 6). When an affirmative answer "YES" is obtained at step 102, the program proceeds to step 103, in which the selected sewing pattern is displayed. At step 104, the CPU judges whether or not the operation of the sewing machine has been required. When an affirmative answer "YES" is obtained at step 104, the program proceeds to step 105, in which a motor for the sewing machine is driven. At step 106, the CPU judges whether the intermittent gathering pattern has been demanded. When an affirmative answer "YES" is obtained at step 106, the program proceeds to step 107, in which the intermittently gathered seams are formed.

Figure 11:
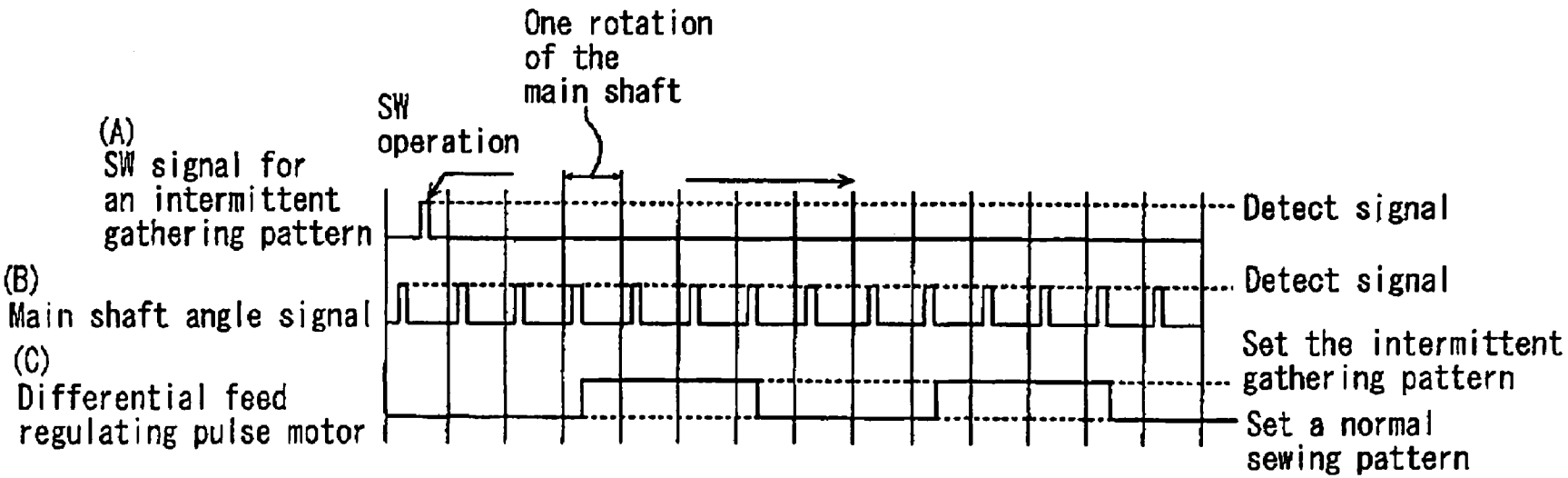
FIG. 11 is a time chart for explaining a control signal for the intermittent gathering pattern according to the embodiment of the present invention.

With reference to FIG. 11, when a switch signal for the intermittent gathering pattern is outputted, a drive pulse for driving the differential feed regulating pulse motor 42 rises and is outputted substantially synchronously with falling of a third pulse of a main shaft angle signal. The third pulse of the main shaft angle signal is counted immediately after the output of the switch signal for the intermittent gathering pattern.

Figure 12:
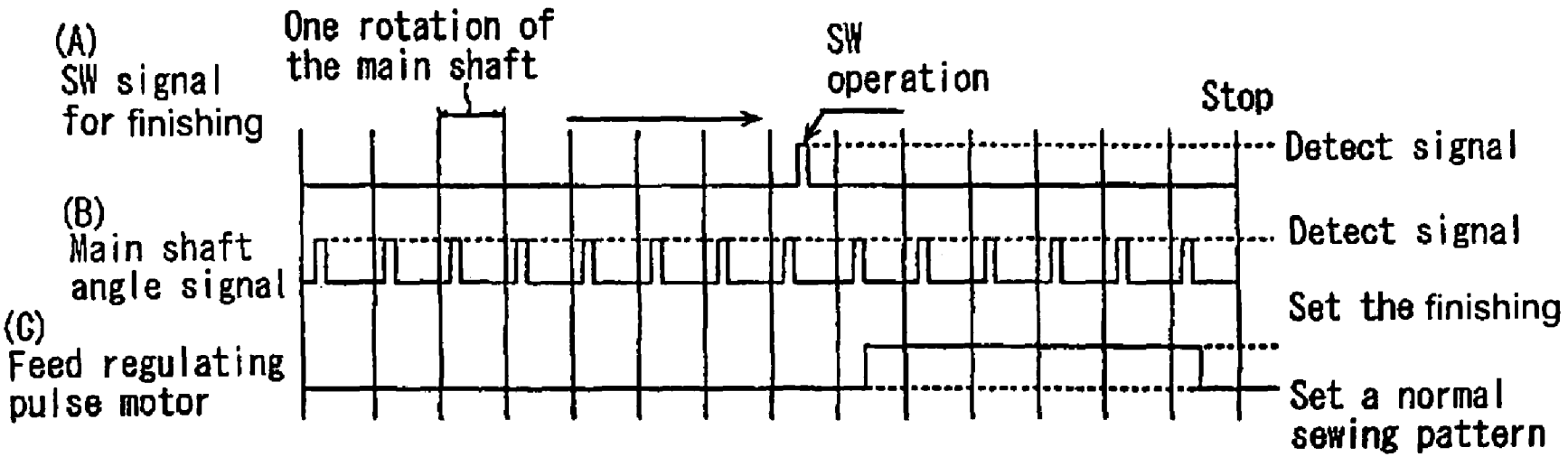
FIG. 12 is a time chart for explaining for explaining a control signal for finishing according to the embodiment of the present invention.
Figure 13:
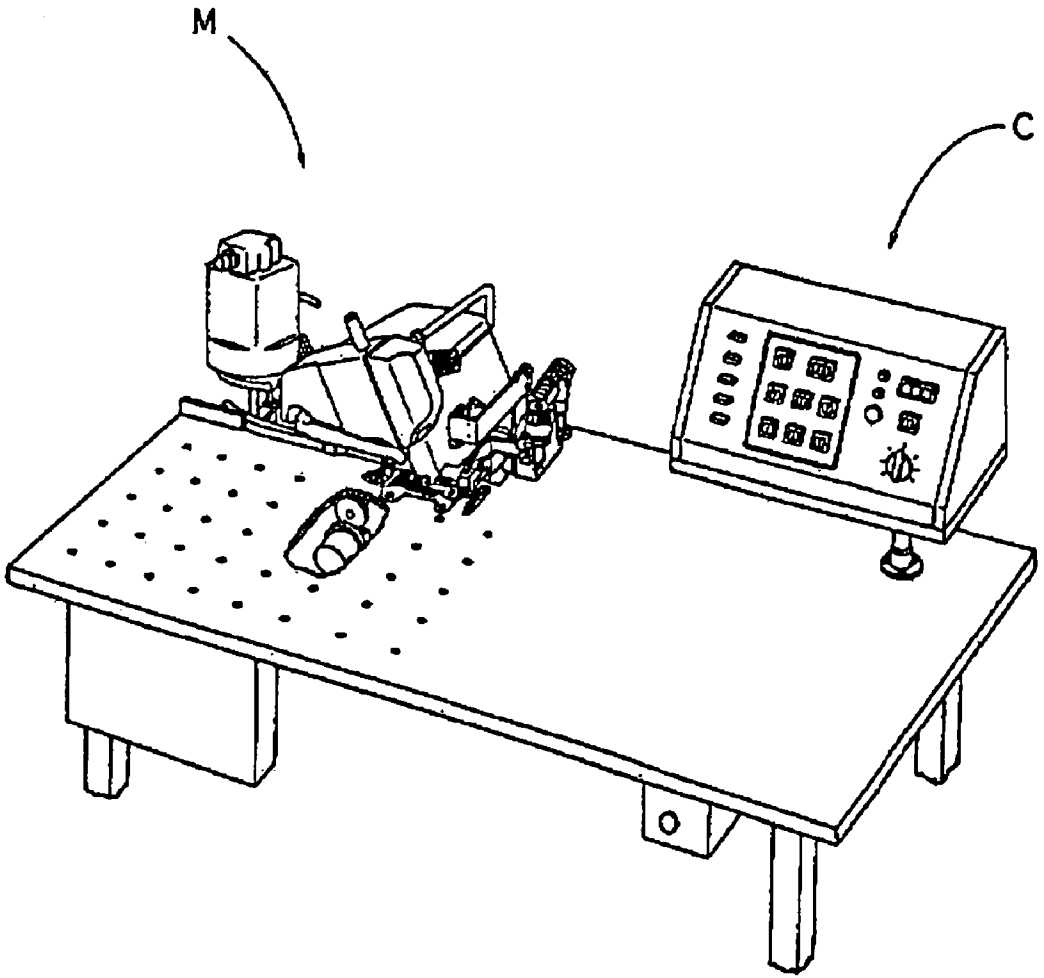
FIG. 13 is a perspective view illustrating an entire structure of a conventional sewing machine.

Returning to the flowchart in FIG. 10, at step 108, the CPU judges whether finishing has been requested. When an affirmative answer "YES" is obtained at step 108, the program proceeds to step 109, in which the process for finishing is performed. With reference to FIG. 12, when a switch signal for the finishing is outputted, a drive pulse for driving the feed regulating pulse motor 19 rises and is outputted substantially synchronously with falling of the first pulse of the main shaft angle signal. The first pulse of the main shaft angle signal is counted immediately after the output of the switch signal for the finishing.

Returning to the flowchart in FIG. 10 again, at step 110, the CPU judges whether the operation of the sewing machine has been requested to stop. When an affirmative answer "YES" is obtained at step 110, the program proceeds to step 111 to stop the operation of a sewing machine motor 100 for the sewing machine.

The following description will be given for explaining the functions of the main feed dog 27 and the differential feed dog 34 by the above-described sewing machine according to the embodiment of the present invention.

The main feeding is operated as follows. As illustrated in FIG. 2, the horizontal feed drive cam 15*a* is rotated integrally with the main shaft 15 rotated by a drive motor (not shown). The reciprocating rotation is generated to the feed shaft 26 by the rotated horizontal feed drive cam 15*a* via the drive rod pin 22 engaged with the feed adjuster 17, the feed connecting rod 23, and the feed drive arm 25. The feed adjuster 17 is adjusted to have an appropriate gradient angle as needed by the feed regulating pulse motor 19 as needed. The rotation of the motor 19 is controlled by a control circuit 81. The reciprocating rotation amount of the feed shaft 26 is adjusted by the feed adjuster 17. The main feed bar drive arm 30 oscillated integrally with the feed shaft 26 moves the main feed bar 28 back and forth via the main feed bar drive rod 32. Further, the main feed dog 27 is moved elliptically by cooperation of the main feed bar drive arm 30 and the feed lifting drive cam 15*e*.

The differential feeding is operated as follows. The differential feed bar drive arm 36 is oscillated integrally with the feed shaft 26. The differential feed bar 35 is moved back and forth by the differential feed bar drive arm 36 via the differential feed bar drive arm pin 37 and the differential feed bar drive rod 38. Further, the differential feed dog 34 is moved elliptically by the cooperation of the differential feed bar drive arm 36 and the feed lifting drive cam 15*e*. The elliptical moving amount of the differential feed dog 34 can be adjusted by regulating a radial dimension of the differential feed bar drive arm 36 from an axis of the feed shaft 26. The regulation of the radial dimension can be achieved by use of the differential feed regulating shaft 40 (a rotational angle of the differential feed regulating shaft 40 can be adjusted by the differential feed regulating pulse motor 42 controlled by the control circuit 81), the differential feed regulating arm 44, and the differential feed regulating link 46. Therefore, the work cloth can be fed by cooperation of the main feeding and the differential feeding.

The following description explains a method of performing intermittent gathering or finishing. The intermittent gathering pattern can be obtained by forming gathered seams and non-gathered seams in an alternating manner. According to the non-limiting embodiment of the present invention, the intermittent gathering pattern can be obtained in accordance with a predetermined control program or a control program set in response to a user's instruction. The user may also select a manual operation, rather than one of the stored programs.

In the predetermined control program for the intermittent gathering pattern, a moving amount of the main feed dog 27 for forming the gathered seams, a ratio of a moving amount of the differential feed dog 34 relative to the moving amount of the main feed dog 27 for forming the gathered seams, a moving amount of the main feed dog 27 for forming the non-gathered seams, a ratio of a moving amount of the differential feed dog 34 relative to the moving amount of the main feed dog 27 for forming the non-gathered seams, and a recommended condition on a sewing length (the sewing length-detected by the number of stitches) for each sewing condition have been preset and memorized. The user selects and determines an appropriate sewing pattern by operating any of the operating portions 2 through 8 while recognizing the various recommended conditions displayed in the displaying device 1. Therefore, the intermittent gathering pattern can be obtained.

In the control program set in response to the user's instruction, while the user recognizes the display device 1, the user sets and determines the moving amount of the main feed dog 27 for forming the gathered seams, the ratio of the moving amount of the differential feed dog 34 relative to the moving amount of the main feed dog 27 for forming the gathered seams, the moving amount of the main feed dog 27 for forming the non-gathered seams, and the ratio of the moving amount of the differential feed dog 34 relative to the main feed dog 27 for forming the non-gathered seams, and the sewing length. The user sets and determines the aforementioned conditions by operating the operating portions 2 through 8.

The predetermined control program and the control program set in response to the user's instructions are both stored in a control substrate 82.provided at the sewing machine. According to the embodiment of the present invention, the control substrate 82 can be integrally fixed to the sewing machine, as a non-limiting example. Each of the programs is called in response to operation of the operating portions 2 through 8.

The following description will be given for explaining control of the moving amount of the main feed dog 27 for forming the intermittent gathering seams and the ratio of the moving amount of the differential feed dog 34 relative to the moving amount of the main feed dog 27 in accordance with the control program. The control program for the intermittently gathered seams is selected by the user and is performed in response to a signal outputted from a needle position detecting device 83 (illustrated in FIG. 3) for an encoder 15*g* (illustrated in FIG. 3) mounted on the main shaft 15. The signal from the needle position detecting device 83 can be applied to detect the number of stitches in accordance with the control program and to determine a timing for initially adjusting each moving amount of the main feed dog 27 and the differential feed dog 34, as non-limiting examples.

As a first process for forming the intermittently gathered seams, the moving amount of the main feed dog 27 for the non-gathered seams and the ratio of the moving amount of the differential feed dog 34 relative to the moving amount of the main feed dog 27 for the non-gathered seams are controlled or shifted to be an appropriate amount or ratio for forming the non-gathered seams in accordance with the predetermined program performed in response to the signal outputted from the needle position detecting device 83. The amount or ratio is controlled or shifted when the needle 14*b* is moved to form the first stitch on the work cloth.

In order to change the moving amount of the main feed dog 27, a control circuit. (not shown) in the control substrate 82 that receives the signal from the needle position detecting device 83 outputs a drive pulse to the feed regulating pulse motor 19. The feed adjuster 17 is then controlled by the feed regulating pulse motor 19 to have an appropriate gradient angle for generating the moving amount of the main feed dog 27 set by the predetermined control program. The moving amount of the main feed dog 27 is changed, for example, when the needle 14*b* and the main feed dog 27 are positioned at good positions, i.e., at an appropriate timing to be changed, in response to the signal from the needle position detecting device 83. Therefore, this type of change does not influence finishing of the intermittent gathering pattern, according to the inventor's experiments.

To change the ratio of the moving amount of the differential feed dog 34 relative to the moving amount of the main feed dog 27, the control circuit (not shown) in the control substrate 82 outputs a drive pulse to the differential feed regulating pulse motor 42. The rotational angle of the differential feed regulating shaft 40 (i.e. the engaging position between the differential feed bar drive arm pin 37 and the guiding groove 36*a* of the differential feed bar drive arm 36) is controlled or shifted to a position for obtaining the ratio of the moving amount of the differential feed dog 34 relative to the moving amount of the main feed dog 27 (the ratio has been predetermined by the control program). The ratio of the moving amount of the differential feed dog 34 relative to the moving amount of the main feed dog 27 is controlled or changed, for example, when the needle 14*b* and the differential feed dog 34 are positioned at good positions, i.e., at an appropriate timing to be changed, in response to the signal from the needle position detecting device 83. Therefore, this type of change does not influence the finishing of the intermittent gathering pattern, according to the inventor's experiments.

As described above, the non-gathered seams are formed with the number of stitches predetermined by the control program after the change of the moving amount of the main feed dog 27 and after the change of the ratio of the differential feed dog 34 relative to the main feed dog 27.

As a second process for forming the intermittent gathering pattern according to the predetermined program for the intermittent gathering, the differential feed regulating pulse motor 42 is transmitted with a drive pulse from the control circuit of the control substrate 82 applied with the signal from the needle position detecting device 83. The differential feed regulating pulse motor 42 controls or shifts the rotational position of the differential feed regulating shaft 40 (i.e., the engaging position between the differential feed bar drive arm pin 37 and the guiding groove 36*a*) to a position for forming the gathered seams predetermined by the control program. Therefore, the gathered seams can be formed with the number of stitches predetermined by the control program.

As a third process for forming the intermittently gathered seams, the differential feed regulating pulse motor 42 receives the drive pulse from the control circuit of the control substrate 82. The differential feed regulating pulse motor 42 controls or shifts the rotational position of the differential feed regulating shaft 40 (i.e., the engaging position between the differential feed bar drive arm pin 37 and the guiding groove 36*a* is returned to the position set in the first sewing process). Therefore, the non-gathered seams can be formed with the number of stitches set by the control program. As described above, the intermittently gathered seams can be formed by repeating the above-described first, second, and third processes.

According to the above-described predetermined control program, the intermittently gathered seams are formed from the first stitch of the needle 14*b*. However, the above-described overlock sewing machine can also start the intermittent gathering pattern after sewing the non-gathered portion at a certain length, as described below.

Figure 5:
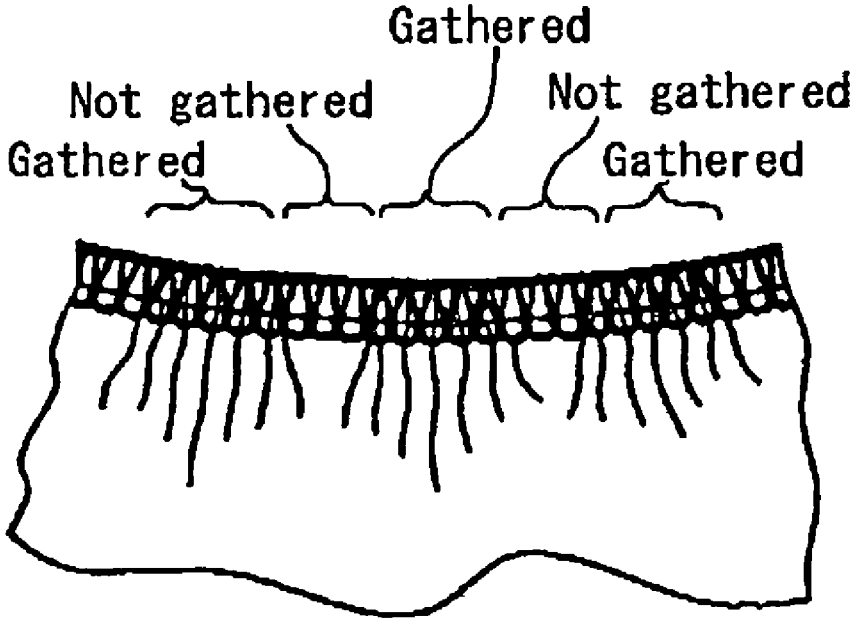
FIG. 5 is an explanatory view for explaining an example of the intermittent gathering seams formed in accordance with a control program according to the embodiment of the present invention.

After sewing the non-gathered seams having a predetermined length, a selected control program for the intermittently gathered seams is initiated by operating the operating portion 10 (arranged near the display device 1) when the needle 14*b* is positioned at an intended position to form the intermittently gathered seams. In this case, the control program is initiated from the aforementioned second process for forming the gathered seams. Each moving amount of the main feed dog 27 and the differential feed dog 34 is controlled in substantially the same manner as described above. Therefore, the description here will be omitted. FIG. 5 illustrates an example of the intermittent gathering patterns obtained by the overlock sewing machine according to the embodiment of the present invention.

According to the non-limiting embodiment of the present invention, the overlock sewing machine can perform not only the aforementioned two types of intermittent gathering patterns but also an intermittent gathering pattern by adjusting the lengths of the non-gathered portion and the gathered portion in response to the user's intention. A method of performing the latter intermittent gathering pattern is described hereinbelow, as a non-limiting example.

Figure 6:
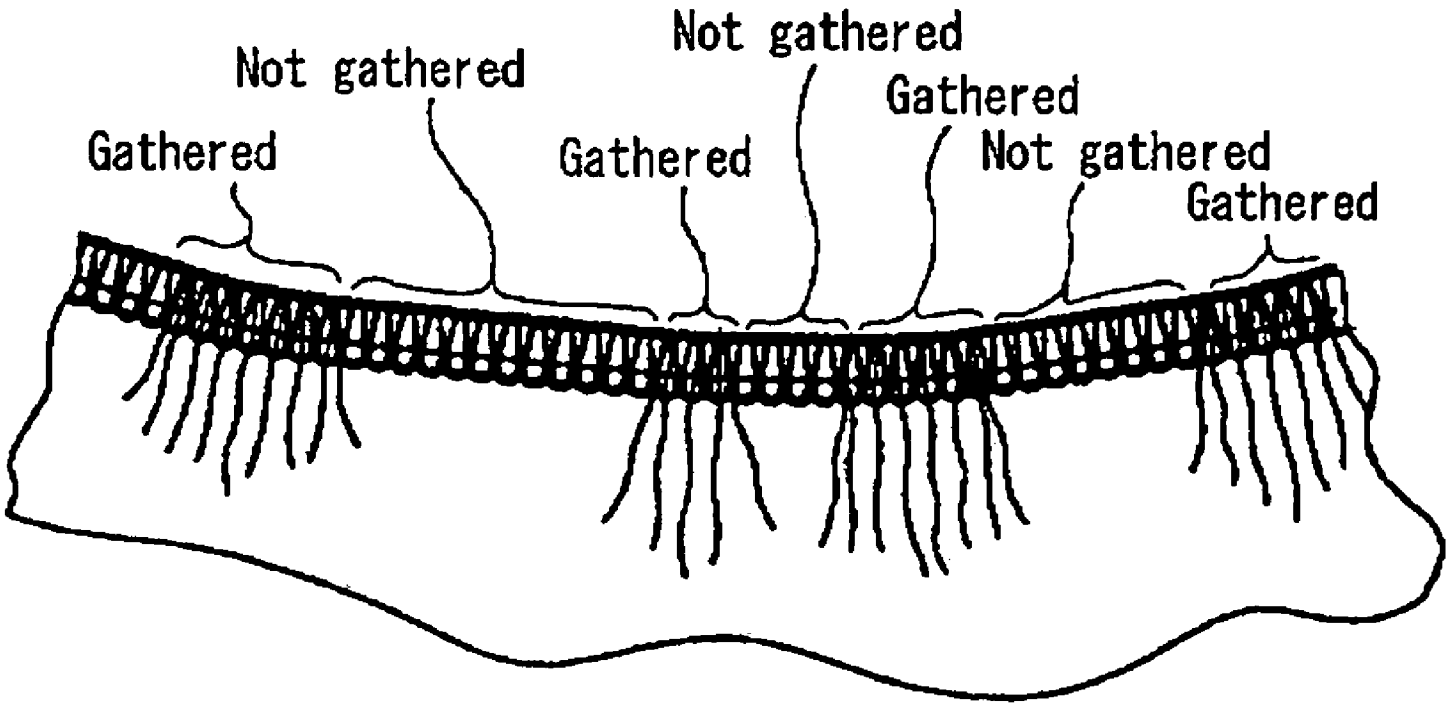
FIG. 6 is an explanatory view for explaining an example of intermittently gathered seams formed by adjusting the length of a gathering portion and a non-gathering portion at respective intended lengths.

As described above, the moving amount of the main feed dog 27 for the non-gathering seams, the ratio of the moving amount of the differential feed dog 34 relative to the moving amount of the main feed dog 27, the moving amount of the main feed dog 27 for forming the gathering seams, and the ratio of the moving amount, of the differential feed dog 34 relative to the moving amount of the main feed dog 27 have been predetermined. Each of the main feeding and the differential feeding is switched from an amount for the non-gathering pattern to an amount for the gathering pattern by operating the operating portion 11 during the sewing process. Each of the main feeding and the differential feeding is switched again from the amount for the gathering pattern to the amount for the non-gathering pattern by releasing the operating portion 11. Therefore, the intermittent gathering seams can be formed with the non-gathered portion and the gathered portion, both of which are adjusted to have an intended sewing length. In this case, the main feeding and the differential feeding is adjusted substantially in the same manner as described above. Further, the moving amounts of the main feed dog 27 for the respective non-gathering and gathering patterns and the ratios of the differential feed dog 34 relative to the main feed dog 27 for the respective non-gathering and gathering patterns can be set substantially in the same manner as described above. FIG. 6 illustrates an example of the intermittent gathering patterns, in which each of the non-gathered portion and the gathered portion is adjusted to have intended length.

The following description will be given for explaining finishing. Finishing, including a snag stitch, is performed by changing a cloth feeding direction in an opposite direction to a normal direction or by minimizing the cloth feeding amount. According to the non-limiting embodiment of the present invention, finishing can be formed by minimizing the moving amount of the main feed dog 27 while maintaining a relative ratio between a cloth feeding amount of the main feed dog 27 and a cloth feeding amount of the differential feed dog 34.

The following description will be given for explaining the structure for finishing. To perform finishing when starting or ending sewing, the operating portion 12 near the display device 1 is operated. The control circuit (not shown) in the control substrate 82 receives a signal from the operating portion 12 and outputs a drive pulse to the feed regulating pulse motor 19. Therefore, the feed adjuster 17 is controlled by the feed regulating pulse motor 19 to have a predetermined gradient angle for obtaining a predetermined moving amount of the main feed dog 27 (the moving amount is appropriate for finishing). The change of the moving amount of the main feed dog 27 for finishing is controlled, for example, when the needle 14*b* and the main feed dog 27 are positioned at good positions, i.e., at an appropriate timing to be changed, in response to the signal from the needle position detecting device 83.

Finishing according to the non-limiting embodiment of the present invention can be performed by adjusting the moving amount of the main feed dog 27 at an appropriate amount for finishing in response to operation of the operating portion 12 arranged near the display device 1 (independently of the activation of the sewing machine), and by adjusting the moving amount of the main feed dog 27 at the appropriate amount for forming the finishing by cooperation of the operation of the operating portion 12 and the activation of the sewing machine. Further, finishing according to the embodiment of the present invention can be performed in accordance with the activation of the sewing machine.

Figure 7:
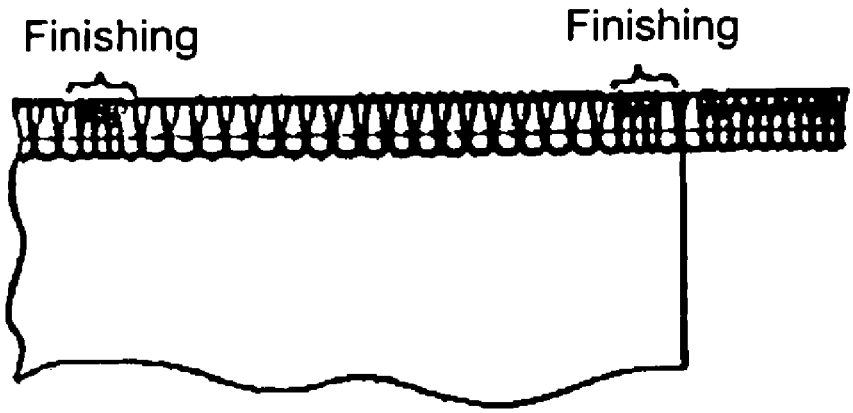
FIG. 7 is an explanatory view for explaining an example of finishing formed by the overlock sewing machine according to the embodiment of the present invention.

The moving amount of the main feed dog 27 appropriate for finishing (the moving amount is controlled by operating the operating portion 12) can be preferably set in response to the respective operations of the operating portions 2 through 8, as required. The set conditions are memorized and called by the control substrate 82 to form the finishing. In order to perform the finishing, the control circuit (not shown) in the control substrate 82 is inputted with a signal from the operating portion 12 and outputs a drive pulse to the feed regulating pulse motor 19. Therefore, the feed adjuster 17 is controlled by the feed regulating pulse motor 19 to have a predetermined gradient angle for obtaining a moving amount of the main feed dog 27 (the moving amount is appropriate for the finishing). Further, after operating the operating portion 12, the activation of the sewing machine is terminated after sewing the predetermined number of stitches based upon the detection of the number of stitches by the needle position detecting device 83. FIG. 7 illustrates an example of the finishing formed by the overlock sewing machine according to the embodiment of the present invention.

As described above, according to the embodiment of the present invention, the overlock sewing machine is provided with the operating portion 10 operated to initiate the intermittent gathering pattern at an intended sewing position, the operating portion 11 operated to perform the intermittent gathering pattern which has a gathering portion at an intended length and a non-gathering portion at an intended length, and the operating portion 12 operated to initiate the finish of stitching. These operating portions 10, 11, and 12 are provided independently. Alternatively, according to a non-limiting modification of the embodiment, a single element can be provided in substitution for the three operating portions 10, 11, and 12.

Figure 8:
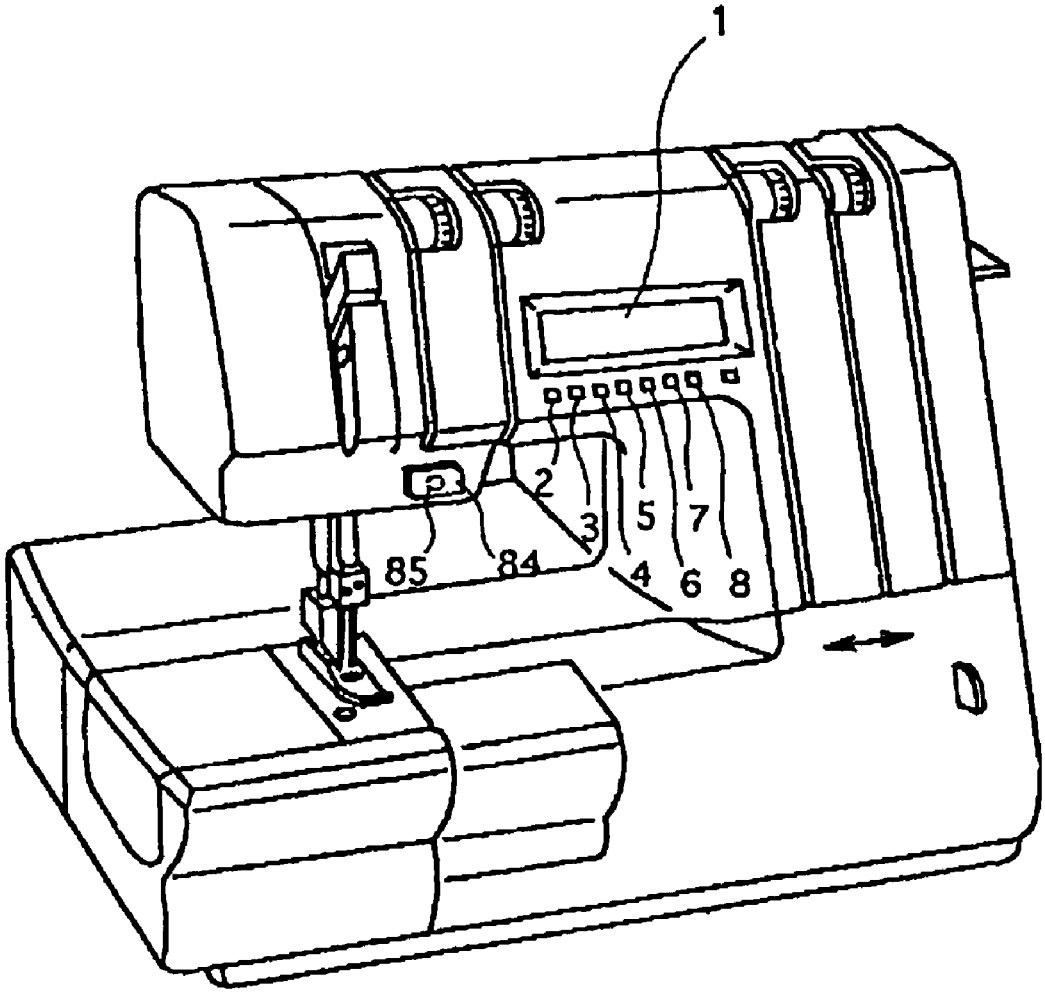
FIG. 8 is a perspective view illustrating an exterior view of an overlock sewing machine according to a non-limiting modified embodiment of the present invention.

As illustrated in FIG. 8, the overlock sewing machine is provided with an operating portion 84. When the operating portion 84 is operated, there are several sewing patterns to be selected: (1) to initiate a control program at an intended position; (2) to form a gathering portion at an intended length and a non-gathering portion at an intended length; and (3) to perform finishing, as non-limiting examples. Any one of them is determined in response to the operation of the operating portions 2 through 8. The user can recognize the selected sewing pattern in reference to the display device 1 and/or in reference to an LED 85, (e.g., a light source), mounted in the operating portion 84.

The operating portion 84 is made of a material that enables the user to recognize the luminous color of the LED 85 from outside. According to the modified embodiment of the present invention, the three types of sewing patterns selected in response to the operation of the operating portion 84 are designed corresponding to three luminous colors of the LED 85. Therefore, the user can recognize the sewing pattern in accordance with the luminous color of the LED 85.

The overlock sewing machine according to the embodiments of the present invention is provided with plural needles and plural loopers. Over-edge seams and decorative stitches can be formed on the work cloth by the threads respectively provided for the needles and loopers. Further, the overlock sewing machine according to the embodiments of the present invention can form the intermittent gathering seams and the finishing by electrically controlling the moving amounts of the main feed dog and the differential feed dog.

As described above, the respective elements for performing the above sewing patterns are provided at a main body of a home overlock sewing machine. It is preferable that the respective elements are integrally provided with the main body of the home overlock sewing machine. Therefore, the sewing machine can be downsized. Further, the respective elements have been assembled at an area where the user can relatively easily approach, thereby improving operationality and safety of the sewing machine.

Additionally, the overlock sewing machine can be provided with a single element which functions substantially in the same manner as the operating portion operated to initiate the intermittent gathering pattern at an intended sewing position, the operating portion operated to perform the intermittent gathering pattern which has a gathering portion at an intended length and a non-gathering portion at an intended length, and the operating portion operated to initiate the finishing. Therefore, this type of overlock sewing machine can be manufactured with higher operationality and better appearance. Further, since this type of overlock sewing machine does not require a large exterior area for mounting several elements therein. In this case, an inner space of the sewing machine can be enlarged. Therefore, the mounting portion of the single element (i.e., the operating portion 84) is not limited as much as the mounting portions of the several elements (i.e. the operating portions 10, 11, and 12). Still further, the sewing machine with the fewer components can be manufactured at a lower cost.

The principles, embodiments, and modes of operation of the present invention have been described in the foregoing specification and drawings. However, the invention which is intended to be protected is not to be construed as limited to the particular embodiments disclosed. Further, the embodiments described herein are to be regarded as illustrative rather than restrictive. Plural objectives are achieved by the present invention, and yet there is usefulness in the present invention as far as one of the objectives are achieved. Variations and changes may be made by others, and equivalents employed, without departing from the spirit of the present invention. Accordingly, it is expressly intended that all such variations, changes, and equivalents which fall within the spirit and scope of the present invention as defined in the claims, be embraced thereby.

What is claimed is:

1. An overlook sewing machine, comprising:

a main body;

a needle bar mounted to reciprocate in an axial direction;

plural needles positioned at the needle bar;

a main feeding mechanism adjusted to control a cloth feeding amount of a main feed dog;

a differential feeding mechanism adjusted to control a cloth feeding amount of a differential feed dog;

a memorizing device configured to memorize at least two sewing patterns, the memorizing device being provided at the main body;

a pattern selecting device provided at the main body and configured to select one of the at least two sewing patterns memorized in the memorizing device;

a control device provided at the main body, the control device being capable of changing the selected one of the at least two sewing patterns, while the selected one of the at least two sewing patterns is in use, to another of the at least two sewing patterns to be used; and a display device adjusted to display the selected at least one sewing pattern, the display device being provided at the overlock sewing machine main body, wherein the memorizing device, the pattern select device, the control device, and the display device are housed in the main body, wherein the at least one sewing pattern includes at least one of an over-edge chain stitch sewing pattern, a finishing pattern, and an intermittent gathering pattern, and wherein the pattern selecting device includes a first operating portion operated for initiating the intermittent gathering pattern, and a second operating portion operated for initiating the finishing pattern.

2. The overlock sewing machine according to claim 1, further comprising plural looper mechanisms.

3. The overlock sewing machine according to claim 1, wherein the intermittent gathering pattern is performed by repeatedly changing a feeding amount of the differential feed dog relative to a feeding amount of the main feed dog based on an intended number of stitches.

4. The overlock sewing machine according to claim 1, wherein the finishing pattern is performed by substantially simultaneously minimizing feeding amounts of the main feed dog and the differential feed dog based on an intended number of stitches.

5. The overlock sewing machine according to claim 1, wherein the first operating portion includes a first operating switch configured to output a signal for initiating the intermittent gathering pattern, and the second operating portion includes a second operating switch configured to output a signal for initiating the finishing pattern.

6. The overlock sewing machine according to claim 1, wherein the first and second operating portions are integrally provided with a third operating portion for performing the intermittent gathering pattern.

7. The overlock sewing machine according to claim 1, wherein the display device is configured to display the selected at least one pattern.

8. An overlock sewing machine, comprising:

a main body;

a needle bar mounted to reciprocate in an axial direction;

plural needles positioned at the needle bar;

a main feeding mechanism adjusted to control a cloth feeding amount of a main feed dog;

a differential feeding mechanism adjusted to control a cloth feeding amount of a differential feed dog;

a memorizing device configured to memorize at least one sewing pattern, the memorizing device being provided at the main body;

a pattern selecting device provided at the main body and configured to select the at least one sewing pattern memorized in the memorizing device or to select a manual operation; and a control device provided at the main body and configured to control the selected at least one sewing pattern, the at least one sewing pattern including an intermittent gathering pattern and a finishing pattern, the intermittent gathering pattern being performed by repeatedly changing a feeding amount of the differential feed dog relative to a feeding amount of the main feed dog based on an interval of an intended number of stitches, and the finishing pattern being performed by substantially simultaneously minimizing feeding amounts of the main feed dog and the differential feed dog based on an intended number of stitches.

9. The overlock sewing machine according to claim 8, wherein the at least one sewing pattern further includes an over-edge chain stitch pattern and a double-thread chain stitch.

10. The overlock sewing machine according to claim 9, wherein the pattern selecting device includes a first operating portion configured to initiate the intermittent gathering pattern, and a second operating portion configured to initiate the finishing pattern.

11. The overlock sewing machine according to claim 8, wherein the selected at least one sewing pattern is changed to a second at least one sewing pattern when the selected at least one sewing pattern is in use.

12. The overlock sewing machine according to claim 8, wherein the first operating portion includes a first operating switch configured to output a signal for performing the selected at least one pattern when the first operating switch is operated during the manual operation.

13. The overlock sewing machine according to claim 12, wherein the selected at least one pattern includes an intermittent gathering pattern.

14. The overlock sewing machine according to claim 12, wherein the second operating portion includes a second operating switch configured to output a signal for initiating a second at least one sewing pattern when the second operating switch is operated during the manual operation.

15. The overlock sewing machine according to claim 14, wherein the second at least one sewing pattern includes a finishing pattern.

16. The overlock sewing machine according to claim 14, wherein the first and second operating switches include a single member, and the single member is provided with a luminous portion configured to emit at least one light having at least one color.

17. The overlock sewing machine according to claim 16, wherein the luminous portion includes a light-emitting diode.

18. The overlock sewing machine according to claim 8, wherein the memorizing device, the pattern selecting device, the control device, and the display device are housed in the main body.

19. A method of changing a first sewing pattern to a second sewing pattern when the first sewing pattern is in use, the method comprising:

presenting at least one sewing pattern to a user;

recognizing selection of a first sewing pattern;

acknowledging the selection of the first sewing pattern to the user;

driving a motor for the sewing machine when operation of the sewing machine is required;

detecting selection of a second sewing pattern; and transitioning to the second sewing pattern while the first sewing pattern is in use.

20. The method according to claim 19, wherein the first sewing pattern includes an intermittent gathering pattern and the second sewing pattern includes a finishing pattern.

21. An overlock sewing machine, comprising:

a main body;

a needle bar mounted to reciprocate in an axial direction;

plural needles positioned at the needle bar;

first means for controlling a cloth feeding amount of a main feed dog;

second means for controlling a cloth feeding amount of a differential feed dog;

means for memorizing at least one sewing pattern;

means for selecting the at least one sewing pattern or for selecting a manual operation;

means for displaying the selected at least one sewing pattern; and means for controlling the selected at least one sewing pattern, wherein the selected at least one sewing pattern is changed to a second sewing pattern while the selected at least one sewing pattern is in use.

22. The overlook sewing machine according to claim 21, wherein the first means for controlling includes the second means for controlling.

23. The overlook sewing machine according to claim 21, wherein the at least one sewing pattern includes at least one of an over-edge chain stitch sewing pattern, a finishing pattern, and an intermittent gathering pattern.

24. The overlock sewing machine according to claim 21, wherein the means for selecting the at least one sewing pattern includes first means for initiating the intermittent gathering pattern and second means for initiating the finishing pattern.

25. The overlock sewing machine according to claim 24, wherein the first means for initiating the intermittent gathering pattern includes a first switch for outputting a signal for initiating the intermittent gathering pattern, and the second means for initiating the finishing pattern includes a second switch for outputting a signal for initiating the finishing pattern.

26. The overlook sewing machine according to claim 25, wherein the first and second switches are integrally provided as a single member.

27. The overlock sewing machine according to claim 21, wherein the means for memorizing, the means for selecting, the means for controlling, and the means for displaying are substantially integrally provided at the main body.

28. The overlock sewing machine according to claim 23, wherein the single member includes means for emitting light to indicate a selected sewing pattern.

* * * * *